US010044125B2

(12) United States Patent
Qiu et al.

(10) Patent No.: US 10,044,125 B2
(45) Date of Patent: Aug. 7, 2018

(54) ELECTRICAL CONNECTOR POWER TERMINAL HAVING A WIDENED THINNER AND LOWER SECTION

(71) Applicant: FOXCONN INTERCONNECT TECHNOLOGY LIMITED, Grand Cayman (KY)

(72) Inventors: Jin-Guo Qiu, Huaian (CN); Jun Zhao, Huaian (CN); Wei Wen, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/647,288

(22) Filed: Jul. 12, 2017

(65) Prior Publication Data

US 2018/0019531 A1 Jan. 18, 2018

(30) Foreign Application Priority Data

Jul. 12, 2016 (CN) ..... 2016 1 0544310

(51) Int. Cl.
*H01R 24/00* (2011.01)
*H01R 33/00* (2006.01)
(Continued)

(52) U.S. Cl.
CPC ..... *H01R 13/02* (2013.01); *H01R 12/7088* (2013.01); *H01R 12/718* (2013.01);
(Continued)

(58) Field of Classification Search
CPC ..... H01R 23/02; H01R 24/60; H01R 24/62; H01R 13/6581; H01R 13/6593
(Continued)

(56) References Cited

U.S. PATENT DOCUMENTS

2015/0162714 A1* 6/2015 Yu ..... H01R 24/62 439/660
2015/0318646 A1* 11/2015 Little ..... H01R 4/023 439/78

(Continued)

FOREIGN PATENT DOCUMENTS

CN 203813082 U 9/2014
CN 204118317 U 1/2015

(Continued)

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes: an housing including a base portion and a tongue portion; and an upper and lower rows of conductive terminals retained to the housing, each row of conductive terminals including a pair of grounding terminals at two outer ends thereof and a power terminal immediately inwardly of one of the pair of grounding terminals, each conductive terminal having a contacting section exposed to a surface of the tongue portion, a tail section extending out of the base portion, and a retaining section between the contacting section and the tail section; the power terminal has a widened section extending from the contacting section thereof toward an adjacent grounding terminal and embedded in the tongue portion; a thickness of the widened section is less than a thickness of the contacting section; a bottom surface of the widened section is lower than a bottom surface of associated contacting section.

17 Claims, 12 Drawing Sheets

(51) Int. Cl.

| | |
|---|---|
| ***H01R 13/02*** | (2006.01) |
| ***H01R 13/6582*** | (2011.01) |
| ***H01R 13/627*** | (2006.01) |
| ***H01R 12/71*** | (2011.01) |
| ***H01R 12/70*** | (2011.01) |

(52) U.S. Cl.
CPC ..... *H01R 13/6271* (2013.01); *H01R 13/6582* (2013.01); *H01R 12/707* (2013.01)

(58) Field of Classification Search
USPC ..... 439/660, 676, 607.55
See application file for complete search history.

(56) References Cited

U.S. PATENT DOCUMENTS

2016/0181743 A1* 6/2016 Tsai ..... H01R 12/724 439/587
2016/0181744 A1* 6/2016 Kao ..... H01R 24/60 439/676
2016/0322753 A1* 11/2016 Cheng ..... H01R 13/631
2017/0294726 A1* 10/2017 Tsai ..... H01R 12/716
2017/0346238 A1* 11/2017 Ju ..... H01R 13/6583

FOREIGN PATENT DOCUMENTS

| | | | |
|---|---|---|---|
| CN | 204243365 | U | 4/2015 |
| CN | 204304072 | U | 4/2015 |
| CN | 204315771 | U | 5/2015 |
| CN | 204391414 | U | 6/2015 |
| CN | 104810657 | A | 7/2015 |
| CN | 204696302 | U | 10/2015 |
| CN | 105024197 | A | 11/2015 |
| CN | 204966754 | U | 1/2016 |
| TW | M511150 | | 10/2015 |

* cited by examiner

ELECTRICAL CONNECTOR POWER TERMINAL HAVING A WIDENED THINNER AND LOWER SECTION

BACKGROUND OF THE INVENTION

1. Field of the Invention

The present invention relates to a dual orientation electrical connector including power terminals having an integrated widened section that is thinned and lowered for ease of being embedded. The invention relates to the copending application Ser. No. 15/629,771 filed on Jun. 22, 2017, having the same applicant and the same inventors with a title of ELECTRICAL CONNECTOR.

2. Description of Related Arts

China Patent No. 105024197, issued on Nov. 4, 2015, discloses an electrical connector including an insulative housing, an upper and lower rows of terminals, and a shell assembled to the insulative housing. The lower row of terminals include outermost grounding terminals and adjacent power terminals. A contacting section of each power terminal is so formed by tearing the material as to have a side section at a front thereof in order to widen the power terminal for large current conduction. Each grounding terminal has an integral side latch so as to do without a middle shielding plate otherwise provided between the two rows of terminals.

SUMMARY OF THE INVENTION

An electrical connector comprises: an insulative housing including a base portion and a tongue portion; and an upper and lower rows of conductive terminals retained to the insulative housing, each row of conductive terminals including a pair of grounding terminals at two outer ends thereof and a power terminal immediately inwardly of one of the pair of grounding terminals, each conductive terminal having a contacting section exposed to a surface of the tongue portion, a tail section extending out of the base portion, and a retaining section between the contacting section and the tail section; wherein the power terminal has a widened section extending from the contacting section thereof toward an adjacent grounding terminal and embedded in the tongue portion; a thickness of the widened section is less than a thickness of the contacting section; and a bottom surface of the widened section is lower than a bottom surface of associated contacting section.

DETAILED DESCRIPTION OF THE PREFERRED EMBODIMENT

Figure 1:
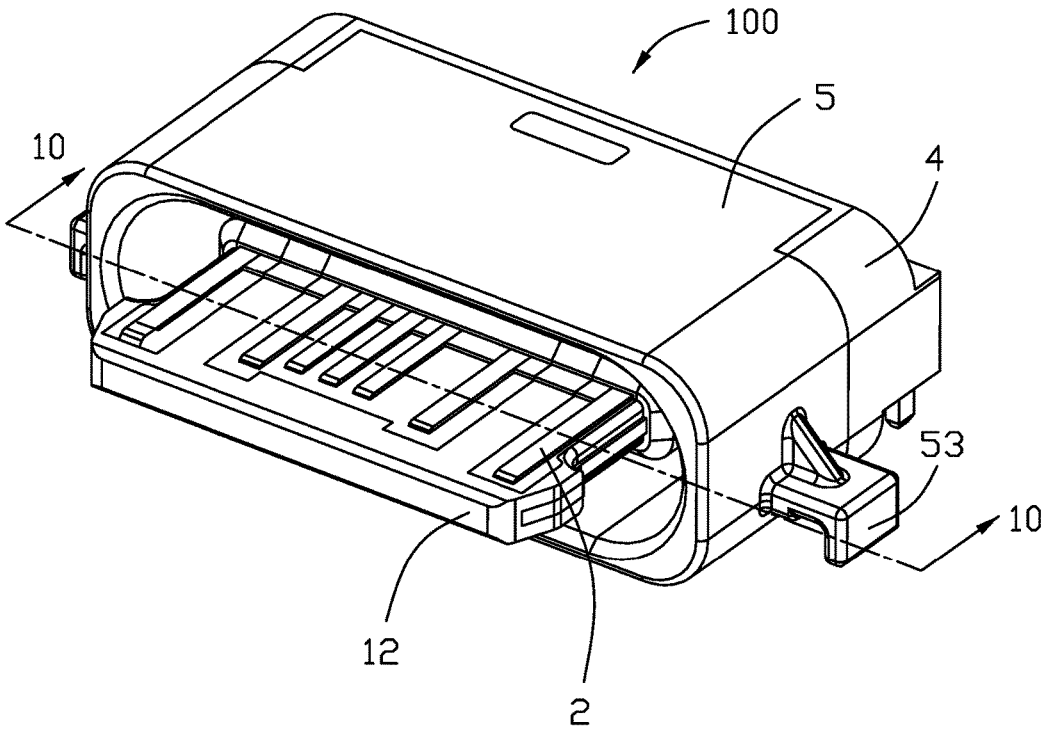
FIG. 1 is a perspective view of an electrical connector in accordance with the present invention.
Figure 2:
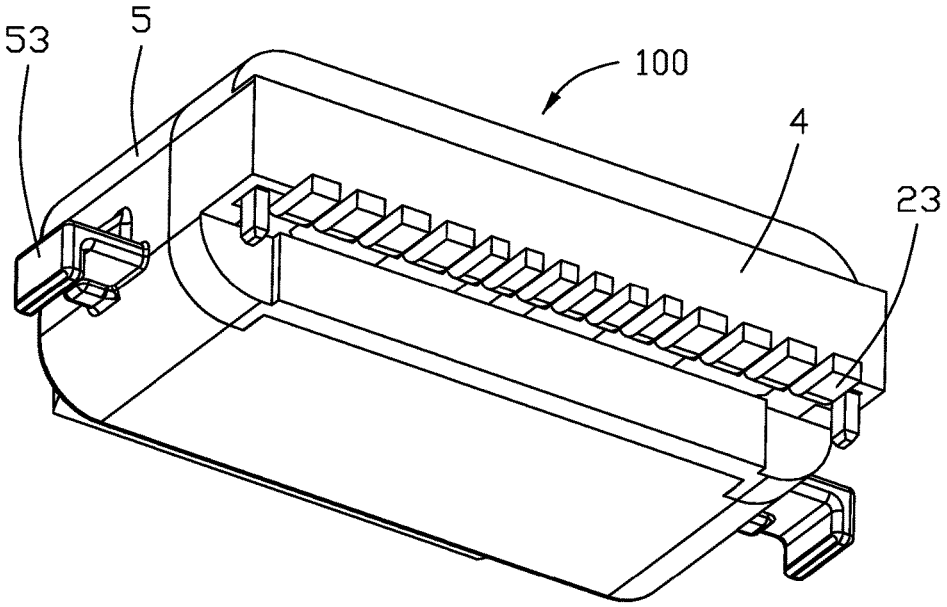
FIG. 2 is another perspective view of the electrical connector.
Figure 3:
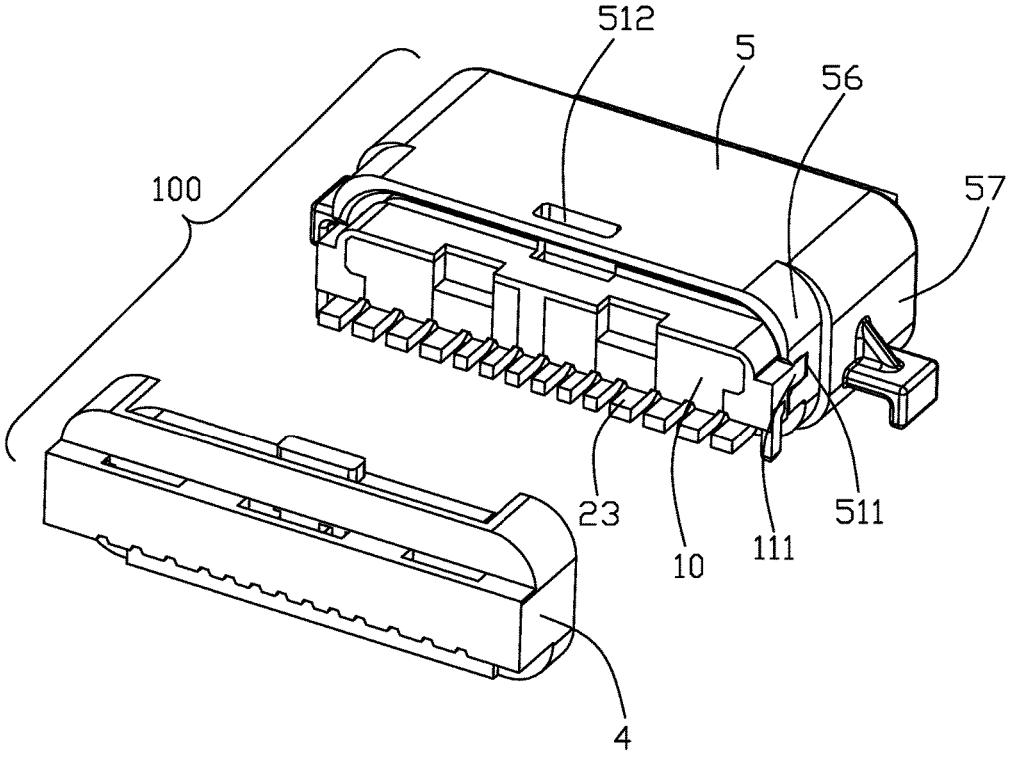
FIG. 3 is a partial exploded view of the electrical connector.
Figure 4:
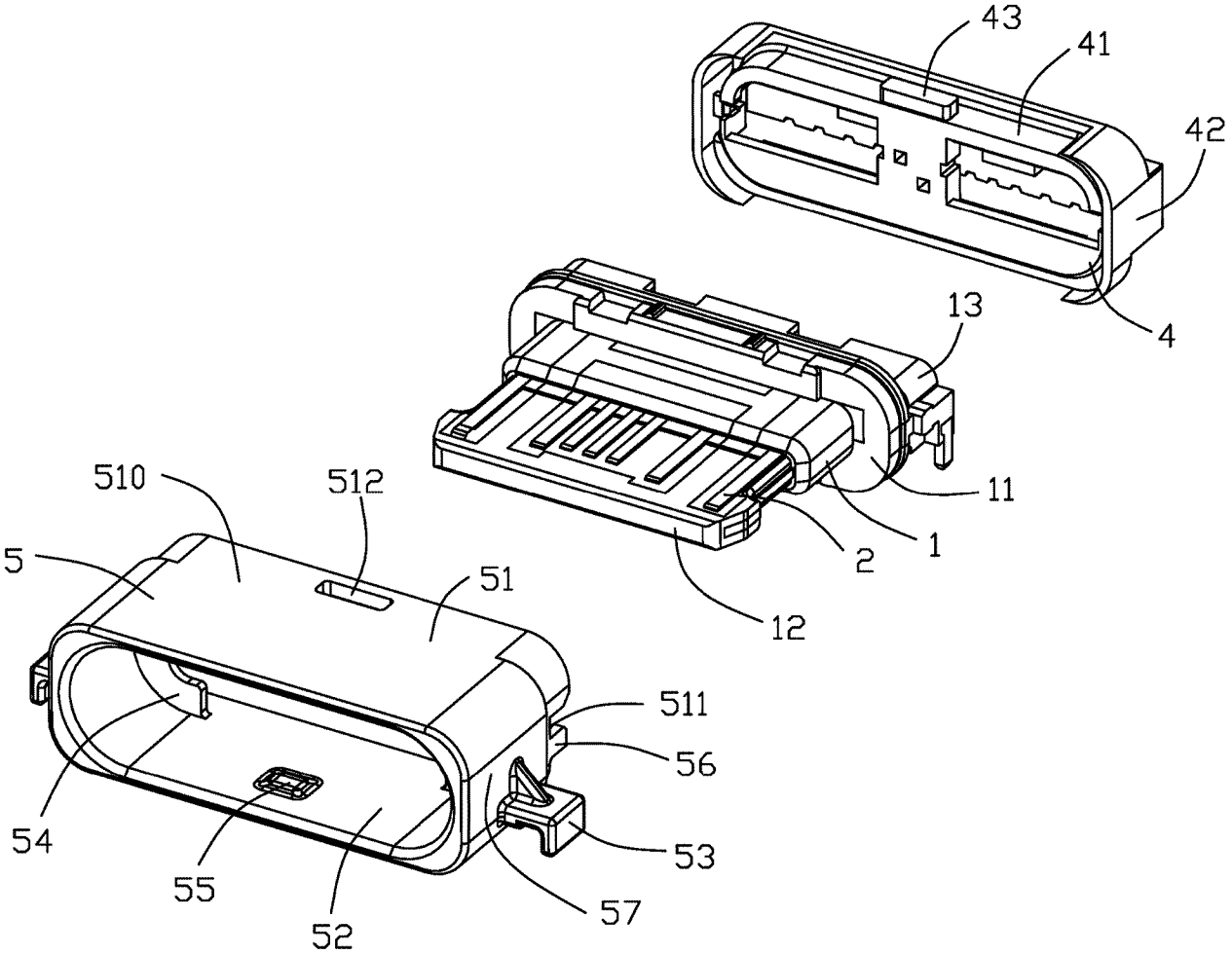
FIG. 4 is a further exploded view of the electrical connector.
Figure 5:
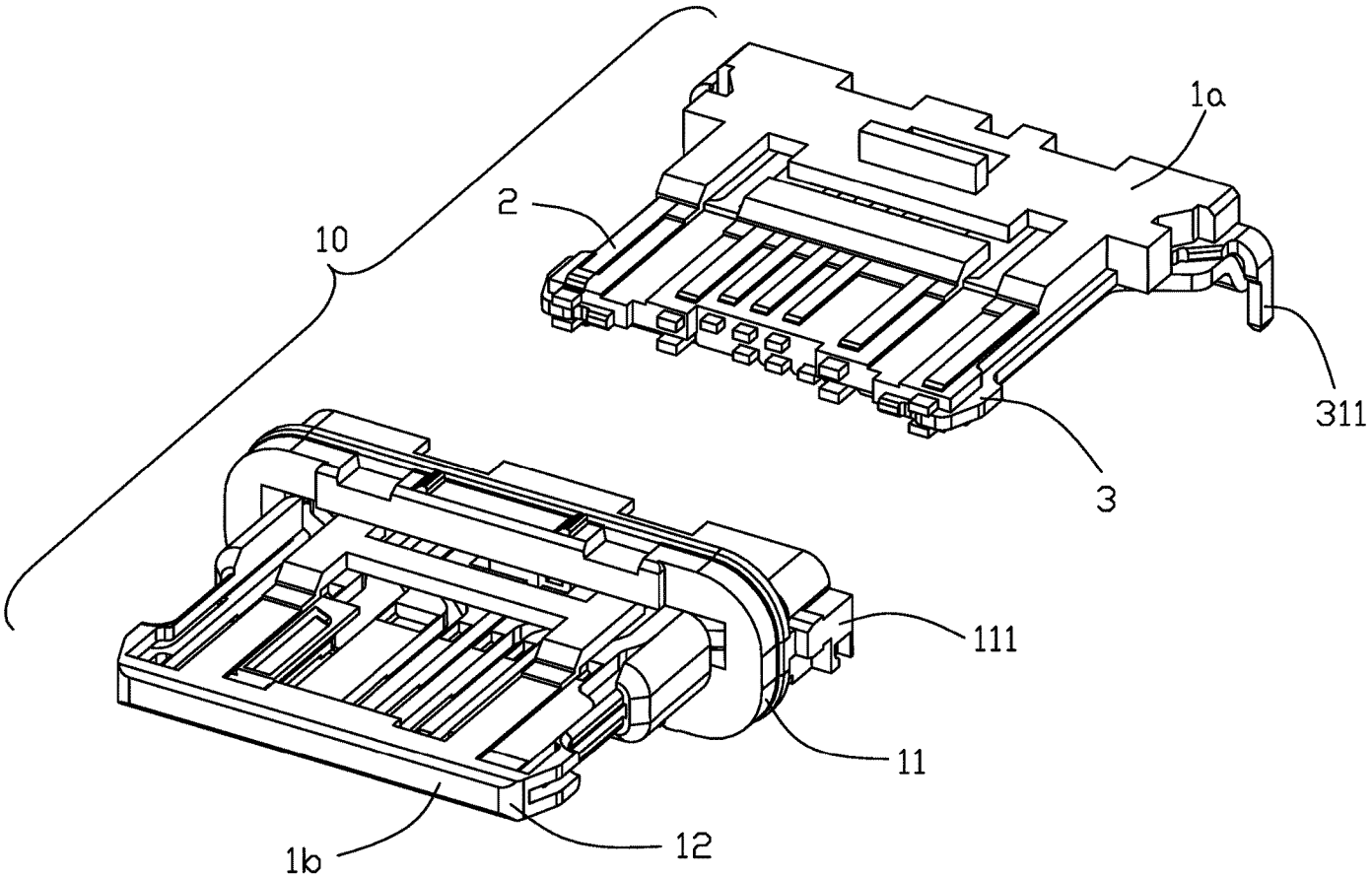
FIG. 5 is a partial exploded view of a contact module of the electrical connector.
Figure 6:
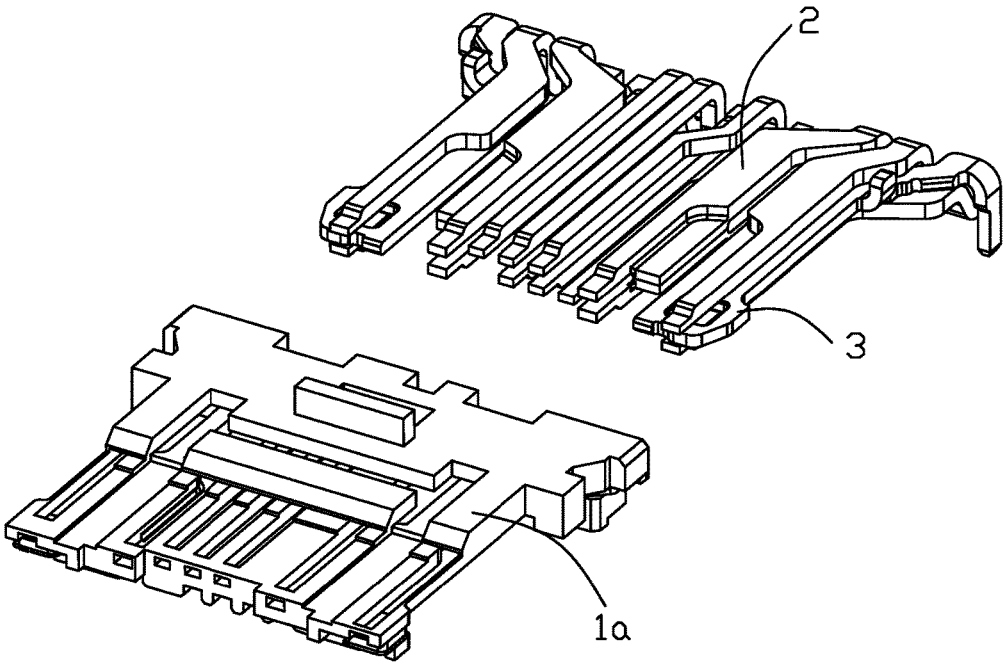
FIG. 6 is a further exploded view of a part of the contact module.
Figure 7:
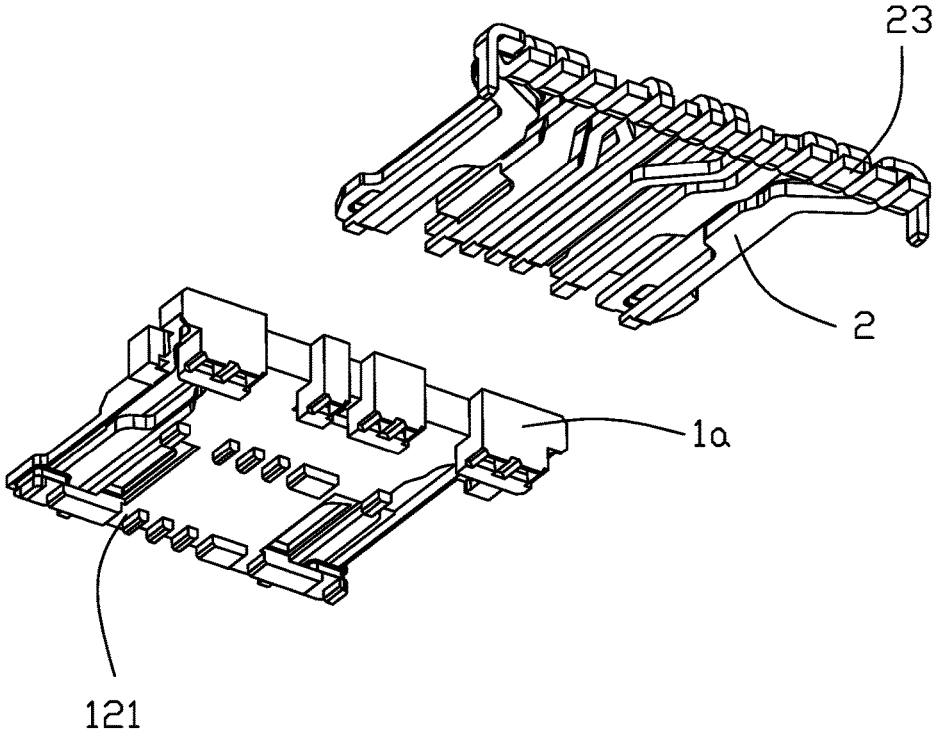
FIG. 7 is a view similar to FIG. 6 but from another perspective.
Figure 8:
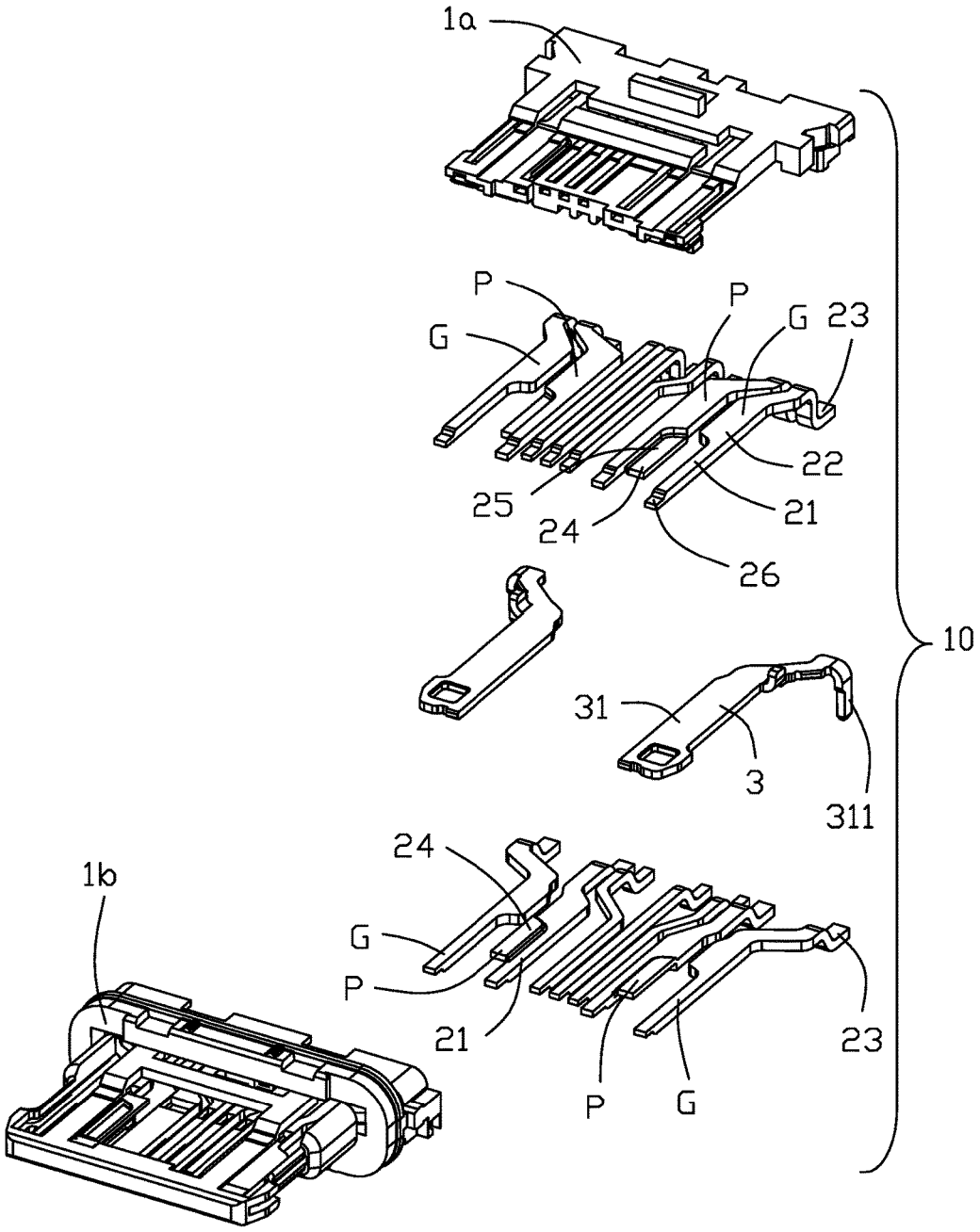
FIG. 8 is another exploded view of the contact module.
Figure 9:
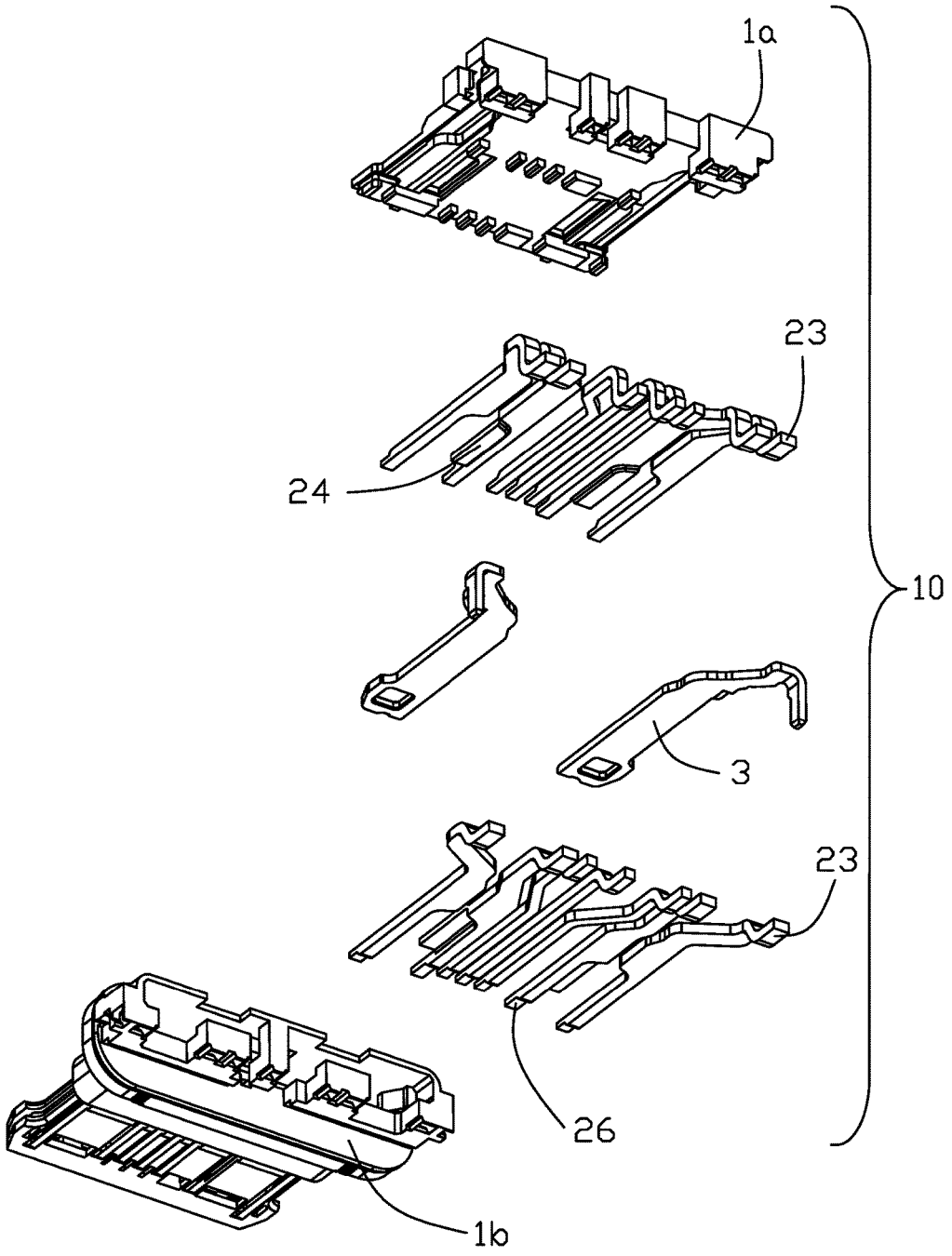
FIG. 9 is a view similar to FIG. 8 but from another perspective.

Referring to FIGS. 1 to 12, an electrical connector 100 includes an insulative housing 1 having a base portion 11, a front tongue portion 12, and a rear stand 13, and an upper and lower rows of conductive terminals 2 retained to the insulative housing 1. In this embodiment, the insulative housing 1 and the upper and lower rows of conductive terminals 2 are constructed as a contact module 10. The electrical connector 100 may further include a metal shell 5 enclosing the contact module 10 and a sealer 4 formed of glues sealing at a rear thereof. The contact module 10 may further include a middle shielding plate 3.

The tongue portion 12 extends forwardly from the base portion 11, and the conductive terminals 2 are arranged in reverse symmetry in two rows.

In construction, the insulative housing 1 includes a first/inner insulator 1*a* over-molded with a second/outer insulator 1*b*. The first insulator 1*a* has terminal-receiving grooves 121. The base portion 11 is formed by a rear end of the first insulator 1*a* and a rear end of the second insulator 1*b*. The base portion 11 has a pair of engaging portions 111. The tongue portion 12 is formed by a front end of the first insulator 1*a* and a front end of the second insulator 1*b*.

Figure 10:
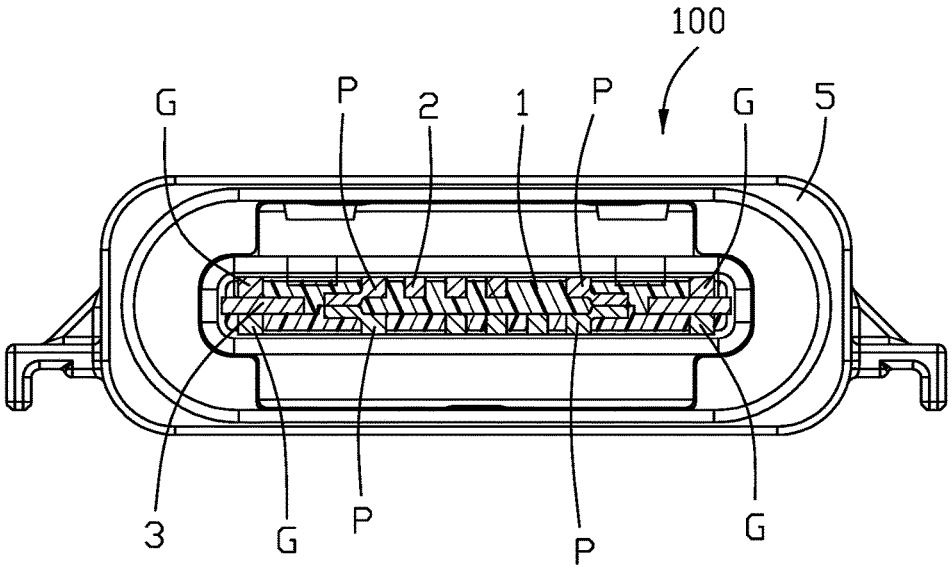
FIG. 10 is a cross-sectional view of the electrical connector taken along line A-A in FIG. 1.
Figure 11:
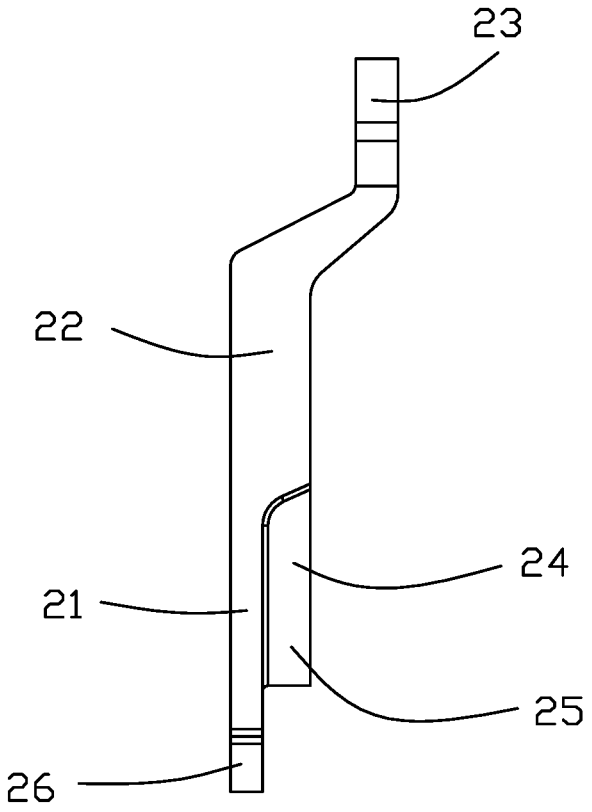
FIG. 11 is a top view of a power contact of the contact module.
Figure 12:
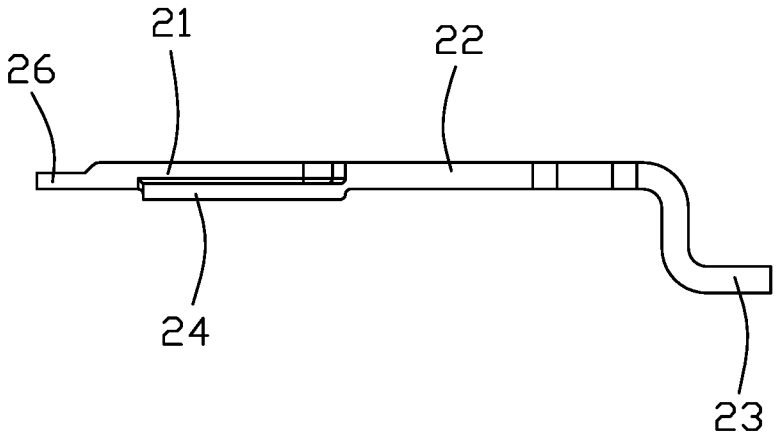
FIG. 12 is a side view of the power contact.

The conductive terminals 2 include two outermost grounding terminals G, a number of power terminals P, and a number of signal terminals S. Each terminal 2 includes a contacting portion 21 exposed to a surface of the tongue portion 12, a soldering portion 23 for soldering to a printed circuit board, and a connecting portion 22 between the contacting portion 21 and the soldering portion 23. Each conductive terminal may include a front embedded portion 26. The power terminal P has a widened section 24 extending from associated contacting section 21 toward an adjacent grounding terminal G and embedded in the tongue portion 12. A step 25 is therefore formed in the power terminal P. The widened section 24 is connected with the contacting section 21 by a single continuous transition portion, i.e., without any tearing-up slit, to have a Z-shaped cross-section as seen in FIG. 10. Since the widened section 24 is thinned down, a thickness thereof is less than a thickness of the contacting section 21. Moreover, for the power terminal P, a total width of the widened section 24 and the contacting section 21 is substantially equal to a width of the connecting portion 22. As can be understood, in such case, the single continuous transition portion is substantially L-shaped in the top view of FIG. 11. Further to a thinning operation of the widened section 24, the widened section 24 is also displaced so that a bottom surface thereof is lower than a bottom surface of the contacting section 21. The widened section 24 of each upper power terminal P may be in contact with the widened section 24 of a corresponding lower power terminal P.

The shielding plate 3 may include a pair of separate pieces 31 or a set of shielding plates. Each piece has a rear soldering leg 311.

The metal shell 5 includes a main portion 51 enclosing a receiving cavity 52, a pair of supporting portions 53 at two sides thereof, a pair of stoppers 54, and a protrusion 55 for grounding connection with a mating connector. The main portion 51 has an upper wall 510, a pair of side walls 57, and a pair of engaging slots 511 at a rear thereof. The upper wall 510 has a hole 512. The side wall 57 has a retaining groove 56 in fluid communication with the slot 511.

The sealer 4 has a pair of side retaining portions 42, an upper retaining portion 41, and a protrusion 43 protruding from the portion 41.

A method of making the electrical connector 100 includes the following steps. In a first step, the two rows of conductive terminals 2 are stamped from a metal sheet to include the power terminals P. The widening portion 24 of the power terminal P is formed by thinning as well as displacing so that an upper surface thereof is at a lower level as compared to thinning only. In this way, more plastic materials may be formed above the widening portion 24 to be embedded later in order to strengthen the embedded structure.

Then, the upper terminals are insert molded with the first insulator 1*a*. The lower terminals abut the insert molded first insulator 1*a* and upper terminals in such a way that the upper grounding terminal G and the lower grounding terminal G sandwich the shielding piece 31. The insulative housing 1 is then completed by over-molding the second insulator 1*b* with the lower terminals and the insert-molded first insulator 1*a* and upper terminals. The soldering portions 23 of the terminals 2 are coplanar in a single line in the rear stand 13.

Afterwards, the contact module 10 is assembled in a rear-to-front direction to the metal shell 5 that is formed by metal injection molding.

The sealer 4 is finally formed at a gap between the rear end of the insulative housing 1 and the metal shell 5.

Provision of the widening portion on the power terminal by thinning as well as displacing increases effectiveness of embedding operation. Notably, one feature of the invention is to have the two power terminals P with portions directly stacked with each other in the vertical direction while the two grounding terminals G are spaced from each other by the corresponding shielding plate 3 in the vertical direction, and the signal terminals G are spaced from the corresponding one by the inner insulator in the vertical direction. Another feature is that the power terminal G includes the widened section inwardly offset from the corresponding contacting section in the vertical direction and abutting against that of the opposite power terminal G in the vertical direction while the corresponding contacting sections of these two opposite power terminals P are spaced from each other by the inner insulator 1*a*. Therefore, for each power terminal P the widened section is pressed by the insulative housing in one vertical direction while the contacting section is pressed by the insulative housing in an opposite vertical direction, thus assuring fixation of the power terminal P in the insulative housing. At the same time, in each set of paired/stacked power terminals P, the widened section of one power terminal P is pressed by the insulative housing in one vertical direction while the widened section of the other power terminal P is pressed by the insulative housing in an opposite vertical direction, thus assuring reliable connection therebetween in the vertical direction.

It is also noted that in this embodiment, in each power terminal P the thickness of the widened portion 24 is smaller than that of the contacting portion 21 while the widened portion 24 is offset inwardly in the vertical direction compared with the corresponding contacting portion 21 for abutting against the corresponding widened portion 24 of the paired/stacked power terminal P in the vertical direction but still allowing the corresponding contacting portions 21 of the paired/stacked power terminals P to be spaced from each other by the insulative housing in the vertical direction. In other words, the thickness of the power terminal P is similar/same with that of the signal terminal S or the grounding terminal G for properly exposing the corresponding contacting portion 21 upon the corresponding surfaces of the tongue portion 12 while bringing about abutment between the paired/stacked power terminals P in the vertical direction via the corresponding offset widened portions 24.

In this embodiment, a front embedded portion 26 of the power terminal P is thinned compared with the contacting portion 21 and has a similar thickness of the widened portion 24 while same with the contacting portions 21, such embedded portions 26 of the set of paired power terminals P are spaced from each other by the inner insulator 1*a* in the vertical direction.

In this embodiment, the tongue portion includes an inner insulator made via an insert-molding process, and an outer insulator made via an over-molding process upon said inner insulator, and the contacting sections of the paired power terminals are spaced from each other in the vertical direction by the inner insulator rather by the outer insulator. Differently, in each set of paired power terminals, the corresponding widened sections are pressed toward each other in the vertical direction by the inner insulator and the outer insulator, respectively, while the corresponding contacting sections are supported by only the inner insulator commonly in the vertical direction.

What is claimed is:

1. An electrical connector comprising:

an insulative housing including a base portion and a tongue portion; and an upper and lower rows of conductive terminals retained to the insulative housing, each row of conductive terminals including a pair of grounding terminals at two outer ends thereof and a power terminal immediately inwardly of one of the pair of grounding terminals, each conductive terminal having a contacting section exposed to a surface of the tongue portion, a soldering section extending out of the base portion, and a connecting section between the contacting section and the soldering section; wherein the power terminal has a widened section extending from the contacting section thereof toward an adjacent grounding terminal and embedded in the tongue portion;

a thickness of the widened section is less than a thickness of the contacting section; and a bottom surface of the widened section is lower than a bottom surface of associated contacting section.

2. The electrical connector as claimed in claim 1, wherein the widened section is connected with associated contacting section by a single continuous transition portion.

3. The electrical connector as claimed in claim 2, wherein a total width of the widened section and the contacting section of the power terminal is substantially equal to a width of the connecting portion thereof, and the single continuous transition portion is substantially L-shaped.

4. The electrical connector as claimed in claim 1, wherein each row of conductive terminals include a pair of power terminals located inwardly adjacent to associated grounding terminals, the widened section of each upper power terminal being in contact with the widened section of a corresponding lower power terminal.

5. An electrical connector comprising:

an insulative housing including a base portion and a tongue portion extending forwardly extending from the base portion along a front-to-back direction;

two rows of terminals retained in the housing and opposite to each other in a vertical direction perpendicular to the front-to-back direction, each of said terminals including a contacting section, a soldering section and a connecting section between the contacting section and the soldering section, each row of terminals spanning in a transverse direction perpendicular to both the front-to-back direction and the vertical direction, and including a pair of grounding terminals, a pair of power terminals and few other terminals, each one of the grounding terminals in one row being aligned with a corresponding one of the grounding terminals in the other row in the vertical direction to form a set of paired grounding terminals, each one of the power terminals in one row being aligned with a corresponding one of the power terminals in the other row in the vertical direction to form a set of paired power terminals; and a pair of shielding plates located between said two rows of terminals in the vertical direction; wherein each of said shielding plates is intimated sandwiched between the set of paired grounding terminals in the vertical direction while the sot of paired power terminals are directly stacked with each other in the vertical direction; and wherein in each set of paired power terminals, each of said power terminals includes a widened section offset inwardly in the vertical direction from a lateral side edge of the corresponding contacting section, and the corresponding contacting sections of the set of paired power terminals are spaced from each other by the insulative housing while the corresponding widened sections abut against each other in the vertical direction so as to have the set of power terminals stacked with each other in the vertical direction.

6. The electrical connector as claimed in claim 5, wherein the widened section is thinner than the contacting section in each corresponding power terminal in the vertical direction.

7. The electrical connector as claimed in claim 6, wherein in each set of paired power terminals, each of said power terminals further includes a front embedded portion having a thickness similar to that of the widened section while the front embedded portion of each set of paired power terminals are space from each other in the vertical direction by the insulative housing.

8. The electrical connector as claimed in claim 5, wherein the widened section is hidden behind the insulative housing in the vertical direction while the contacting section is exposed upon the tongue portion in the vertical direction.

9. The electrical connector as claimed in claim 8, wherein the housing is sandwiched between the corresponding contacting sections of the set of paired power terminals in the vertical direction, while the corresponding widened sections of the set of paired power terminals are sandwiched the housing in the vertical direction.

10. The electrical connector as claimed in claim 5, wherein the tongue portion includes an inner insulator made via an insert-molding process, and an outer insulator made via an over-molding process upon said inner insulator, and the contacting sections of the paired power terminals are spaced from each other in the vertical direction by said inner insulator rather by said outer insulator.

11. The electrical connector as claimed in claim 10, wherein in each set of paired power terminals, the corresponding widened sections are pressed toward each other in the vertical direction by the inner insulator and the outer insulator, respectively, while the corresponding contacting sections are supported by the insulator commonly in the vertical direction.

12. An electrical connector comprising:

an insulative housing including a base portion and a tongue portion extending forwardly extending from the base portion along a front-to-back direction; and two rows of conductive terminals retained in the insulative housing and opposite to each other in a vertical direction perpendicular to the front-to-back direction, each of said conductive terminals including a contacting section, a soldering section and a connecting section between the contacting section and the soldering section, each row of conductive terminals spanning in a transverse direction perpendicular to both the front-to-back direction and the vertical direction, and including a pair of grounding terminals, a pair of power terminals and few other conductive terminals, each one of the grounding terminals in one row being aligned with a corresponding one of the grounding terminals in the other row in the vertical direction to form a set of paired grounding terminals, each one of the power terminals in one row being aliened with a corresponding one of the power terminals in the other row in the vertical direction to form a set of paired power terminals: wherein the set of paired power terminals are directly stacked with each other in the vertical direction; wherein in each set of paired power terminals, each of said power terminals includes a widened section offset inwardly in the vertical direction from a lateral side edge of the corresponding contacting section; wherein the widened sections of the set of paired power terminals are hidden behind the housing in the vertical direction while the corresponding contacting sections are exposed upon the tongue portion in the vertical direction.

13. The electrical connector as claimed in claim 12, wherein the widened sections of set of paired powered terminals abut against each other in the vertical direction while the corresponding contacting sections are spaced from each other in the vertical direction by the housing.

14. The electrical connector as claimed in claim 13, wherein thickness of the widened section is smaller than that of the corresponding contacting section in the vertical direction.

15. The electrical connector as claimed in claim 12, further including a pair of shielding plates each intimately sandwiched between the paired grounding terminals in the vertical direction.

16. The electrical connector as claimed in claim 12, wherein the tongue portion includes an inner insulator made via an insert-molding process, and an outer insulator made via an over-molding process upon said inner insulator, and the contacting sections of the paired power terminals are spaced from each other in the vertical direction by said inner insulator rather by said outer insulator.

17. The electrical connector as claimed in claim 16, wherein in each set of paired power terminals, the corresponding widened sections are pressed toward each other in the vertical direction by the inner insulator and the outer insulator, respectively, while the corresponding contacting sections are supported by the insulator commonly in the vertical direction.

* * * * *